US009343003B2

(12) United States Patent
Podd

(10) Patent No.: US 9,343,003 B2
(45) Date of Patent: May 17, 2016

(54) BACKLIT GRAPHIC DISPLAY DEVICE WITH DEVICE-TO-SURFACE MOUNTS

(71) Applicant: George O. Podd, Lake Forest, IL (US)

(72) Inventor: George O. Podd, Lake Forest, IL (US)

( * ) Notice: Subject to any disclaimer, the term of this patent is extended or adjusted under 35 U.S.C. 154(b) by 0 days.

(21) Appl. No.: 14/159,690

(22) Filed: Jan. 21, 2014

(65) Prior Publication Data

US 2014/0130387 A1 May 15, 2014

Related U.S. Application Data

(63) Continuation-in-part of application No. 12/930,832, filed on Jan. 18, 2011, now Pat. No. 8,646,194, which is a continuation-in-part of application No. 12/927,611, filed on Nov. 17, 2010, now abandoned, which is a continuation-in-part of application No. 12/821,944, filed on Jun. 23, 2010, now abandoned, which is a continuation of application No. 11/803,722, filed on May 17, 2007, now abandoned, which is a continuation of application No. 11/444,174, filed on May 31, 2006, now abandoned, which is a continuation-in-part of application No. 11/259,909, filed on Oct. 27, 2005, now abandoned.

(60) Provisional application No. 60/724,476, filed on Oct. 7, 2005, provisional application No. 60/623,754, filed on Oct. 29, 2004.

(51) Int. Cl.

| | |
|---|---|
| ***G09F 9/33*** | (2006.01) |
| ***G09F 13/04*** | (2006.01) |
| ***G09F 13/22*** | (2006.01) |
| ***G09F 21/04*** | (2006.01) |
| ***H05B 37/02*** | (2006.01) |

(52) U.S. Cl.

CPC ..... *G09F 13/0404* (2013.01); *G09F 9/33* (2013.01); *G09F 13/04* (2013.01); *G09F 13/22* (2013.01); *G09F 21/04* (2013.01); *H05B 37/0245* (2013.01)

(58) Field of Classification Search

CPC ..... G09F 9/33; G09F 13/04; G09F 13/22
USPC ..... 40/578, 544, 546, 593, 564, 760, 40/661.09, 797, 791, 790, 781; 362/251, 362/806, 24.129

See application file for complete search history.

(56) References Cited

U.S. PATENT DOCUMENTS

| | | | | |
|---|---|---|---|---|
| 1,410,598 | A * | 3/1922 | Reeves | 40/593 |
| 2,303,988 | A * | 12/1942 | Christensen | 40/574 |
| 3,517,245 | A | 5/1966 | Dickson, Jr. et al. | |

(Continued)

*Primary Examiner* — Syed A Islam
(74) *Attorney, Agent, or Firm* — Christopher J. Scott

(57) ABSTRACT

A graphic display device illuminates interchangeable graphic panels and is mountable to a translucent mounting surface. The graphic display device includes a housing assembly, a light source assembly, a light guide assembly, and device-to-surface mounts. The housing assembly includes a housing back, a housing front, and peripheral housing edging. Together, the housing back and housing edging define a panel-receiving volume. The light source assembly includes a power source, a light source, and circuitry. A light guide of the light guide assembly is positionable within the panel-receiving volume for guiding light from the light source in an anterior direction. The device-to-surface mounts fasten the graphic display device to a translucent mounting surface, and are cooperably associated with the peripheral housing edging for supporting the housing assembly such that the light from the light source is guided in an anterior direction through the translucent mounting surface.

20 Claims, 9 Drawing Sheets

(56) References Cited

U.S. PATENT DOCUMENTS

| | | | | | |
|---|---|---|---|---|---|
| 3,570,158 | A | * | 3/1971 | Hackett | 40/452 |
| 3,665,628 | A | * | 5/1972 | Dammond | 40/792 |
| 3,833,833 | A | * | 9/1974 | Nelson | 315/169.3 |
| 4,109,235 | A | * | 8/1978 | Bouthors | 340/461 |
| 4,138,620 | A | | 2/1979 | Dickson | |
| 4,345,970 | A | | 8/1982 | Radvan et al. | |
| 4,420,898 | A | | 12/1983 | Moses | |
| 4,443,832 | A | | 4/1984 | Kanamori et al. | |
| 4,457,089 | A | * | 7/1984 | Phillips, Jr. | 40/544 |
| 4,466,208 | A | * | 8/1984 | Logan et al. | 40/544 |
| 4,603,065 | A | | 7/1986 | Mori et al. | |
| 4,862,153 | A | | 8/1989 | Nakatani et al. | |
| 4,912,608 | A | * | 3/1990 | Lee | 362/104 |
| 4,914,348 | A | | 4/1990 | Kameyama et al. | |
| 5,005,306 | A | | 4/1991 | Kinstler | |
| 5,015,086 | A | * | 5/1991 | Okaue et al. | 351/44 |
| 5,058,298 | A | * | 10/1991 | Burns | 40/791 |
| 5,239,450 | A | * | 8/1993 | Wall | 362/104 |
| 5,336,345 | A | | 8/1994 | Gustafson et al. | |
| 5,390,436 | A | * | 2/1995 | Ashall | 40/546 |
| 5,444,930 | A | | 8/1995 | Loew | |
| 5,477,433 | A | * | 12/1995 | Ohlund | 362/104 |
| 5,566,384 | A | | 10/1996 | Chien | |
| 5,718,497 | A | * | 2/1998 | Yokoyama et al. | 362/625 |
| 5,957,564 | A | * | 9/1999 | Bruce et al. | 362/84 |
| 6,014,116 | A | * | 1/2000 | Haynes et al. | 345/1.1 |
| 6,205,690 | B1 | * | 3/2001 | Heropoulos et al. | 40/442 |
| 6,216,373 | B1 | * | 4/2001 | Liao | 40/544 |
| 6,314,669 | B1 | * | 11/2001 | Tucker | 40/448 |
| 6,604,834 | B2 | | 8/2003 | Kalana | |
| 6,624,570 | B1 | | 9/2003 | Sano et al. | |
| 6,637,906 | B2 | | 10/2003 | Knoerzer et al. | |
| 6,659,617 | B1 | * | 12/2003 | Michael | 362/104 |
| 6,783,259 | B1 | * | 8/2004 | Macedonio | 362/249.12 |
| 6,799,877 | B2 | * | 10/2004 | Watkins et al. | 382/542 |
| 6,942,916 | B2 | | 9/2005 | Bezenek et al. | |
| 7,001,056 | B2 | * | 2/2006 | Clegg | 362/571 |
| 7,065,909 | B2 | * | 6/2006 | Snyder | 40/544 |
| 7,213,935 | B2 | * | 5/2007 | Lee | 362/104 |
| 7,246,932 | B2 | * | 7/2007 | Burtsev et al. | 362/616 |
| 7,360,926 | B2 | * | 4/2008 | Lee et al. | 362/249.01 |
| 7,681,347 | B1 | * | 3/2010 | Welker et al. | 40/546 |
| 8,240,868 | B1 | * | 8/2012 | Sims | 362/104 |
| 2001/0018809 | A1 | * | 9/2001 | Heropoulos et al. | 40/544 |
| 2001/0030871 | A1 | * | 10/2001 | Anderson et al. | 362/488 |
| 2001/0036354 | A1 | * | 11/2001 | Majors | 386/46 |
| 2002/0148250 | A1 | * | 10/2002 | Pratt | 63/3 |
| 2002/0159245 | A1 | * | 10/2002 | Murasko et al. | 362/84 |
| 2003/0007261 | A1 | * | 1/2003 | Hutzel et al. | 359/838 |
| 2003/0193472 | A1 | * | 10/2003 | Powell | 34/102 |
| 2004/0074966 | A1 | | 4/2004 | Holzer | |
| 2009/0282716 | A1 | * | 11/2009 | Barbieri et al. | 40/606.01 |

* cited by examiner

BACKLIT GRAPHIC DISPLAY DEVICE WITH DEVICE-TO-SURFACE MOUNTS

PRIOR HISTORY

This U.S. patent application is related to and a continuation-in-part patent application of pending U.S. patent application Ser. No. 12/930,832 filed in the United States Patent and Trademark Office on 18 Jan. 2011 to which priority is claimed, which is related to and a continuation-in-part patent application of abandoned U.S. patent application Ser. No. 12/927,611 filed in the United States Patent and Trademark Office on 17 Nov. 2010, which is related to and a continuation-in-part patent application of abandoned U.S. patent application Ser. No. 12/821,944 filed in the United States Patent and Trademark Office on 23 Jun. 2010, which is related to and a continuation patent application of abandoned U.S. patent application Ser. No. 11/803,722 filed in the United States Patent and Trademark Office on 15 May 2007, which is a continuation patent application of abandoned U.S. patent application Ser. No. 11/444,174 filed in the United States Patent and Trademark Office on 31 May 2006, which is a continuation-in-part patent application of abandoned U.S. patent application Ser. No. 11/259,909 filed in the United States Patent and Trademark Office on 27 Oct. 2005, which is related to U.S. Provisional Patent Application No. 60/724,476 filed in the United States Patent and Trademark Office on 7 Oct. 2005, and to U.S. Provisional Patent Application No. 60/623,754 filed in the United States Patent and Trademark Office on 29 Oct. 2004, the entire teachings and the full disclosure of each of the above-identified U.S. patent applications and U.S. provisional patent applications are by reference hereto incorporated into and made a part of these specifications.

BACKGROUND OF THE INVENTION

1. Field of the Invention

This invention relates generally to a light or a lighting device, such as a backlit graphic display device. More particularly, this invention relates to a backlit graphic display device for illuminating a graphics panel, which device can be positioned on or near a window or glass surface, such as on a vehicle.

2. Brief Discussion of Prior Art

Electroluminescent (EL) lamps or devices have been used for signage. There are known methods for manufacturing EL lamps or devices. One conventional emergency exit sign uses an EL lamp in combination with a pilot light which is connected to the EL lamp by way of a photoelectric link. The photoelectric link monitors the brightness of the EL lamp and keeps on the pilot light as long as the EL lamp is lit. Illumination provided by the EL lamp may be less than the illumination of background brightness, making it difficult to tell by looking at the EL lamp whether or not the EL lamp is energized. Thus, the pilot light provides a point of illumination that can be easier to detect than whether the EL lamp is lit. This particular combination can be useful for building inspectors that check the operational status of an exit sign.

Other prior art systems include U.S. Pat. No. 5,390,436 ('436 Patent), issued to Ashall, which '336 Patent discloses a Display System. The '436 Patent describes an edge-lit illuminated display system has a transparent medium having first and second opposing surfaces and at least one edge operable with a light source for illuminating the first and second surfaces, A matrix of dots on each of the surfaces is arranged to allow interaction of light between the surfaces. The matrix of dots on at least one of the surfaces substantially covers the entire surface for providing an even increased illumination throughout the surface, wherein when a graphic image is supported over the surface the graphic image is evenly illuminated.

U.S. Pat. No. 5,718,497 ('497 Patent), issued to Yokoyama et al. discloses a Surface Light Source Device. The '497 Patent describes a surface light source device comprising a light-conducting member consisting of a sheet of transparent material, a linear light source disposed adjacent to an edge surface of the light-conducting member, a diffusion plate disposed on a front surface of the light-conducting member and a reflective plate disposed on a rear side of the light-conducting member. The rear surface of the light-conducting member has depressions or projections. These depressions or projections have rough surfaces. By selecting the shape of the depressions or projections, and controlling the roughness of the rough surfaces, an enhanced uniform brightness distribution is provided.

U.S. Pat. No. 5,957,564 ('564 Patent), issued to Bruce, discloses a Low Power Lighting Display. The '564 Patent describes a lighting display comprising a plurality of electroluminescent lamps (ELs) connected in parallel across a rechargeable battery that is connected to the EL's through an inverter. A solar panel device recharges the battery. Electroluminescent lamps for use in light strings are produced by cutting decorative shapes from existing electroluminescent material and mounting them back to back, in receptacles connected to electric wiring as in conventional light strings. For greater protection and ease of use the lamps may be mounted inside a length of clear plastic tubing, or may be laminated within layers of plastic material.

U.S. Pat. No. 6,783,259 ('259 Patent), issued to Macedonia, discloses an Apparatus for Recreating and Illuminating a Visual Image. The '259 Patent describes an apparatus for recreating and simultaneously illuminating the visual features of a substantially planar visual image using illumination devices, the United States flag being a visual image utilized in one embodiment.

From a review of the foregoing and a consideration of the prior art in general, it will be understood that the prior art perceives a need for a backlit graphic display device for illuminating interchangeable graphic panels, the backlit graphic display device comprising a housing assembly, a light source assembly, a light guide assembly, and laterally opposed device-to-surface mount or retainer structures for fastening the graphic display device to a window wherein the device-to-surface retainer structures each comprise an edge-receiving void as substantially summarized and described hereinafter.

SUMMARY OF THE INVENTION

There is a need to enhance visibility of graphic elements in different places, for many safety reasons and marketable applications. For example, enhanced visibility of graphic elements on vehicles may help overcome low visibility driving conditions, such as snow, rain, darkness and/or fog. With increased visibility of specific graphic elements on a vehicle, other motorists can better see dedicated information, particularly in adverse weather conditions or low visibility driving conditions.

The backlit graphic display device of this invention can be used in any suitable or desirable situation or format, such as a safety signal, a public service symbol including symbols of the Department of Transportation, the Military, the National Guard, the Police and the Fire Departments, a construction sign, a zone authority, a help/warning message, and many other marketable applications, including zone parking passes for major events, promotional icons, vehicle brand logos and advertising messages.

There is also a need for a product according to this invention, to address and satisfy specific criteria for practical or real world use. In one embodiment of this invention, this is achieved by integrating illuminated graphic panels with sensors, a dim switch or sensor and a control module, which can be programmed and/or assembled to operate within specific parameters of a dedicated driving or usage environment.

A backlit graphic display device according to embodiments of this invention can include an electroluminescent (EL) panel integrated or combined with a translucent graphics panel, a light sensor, a motion sensor, a time sensor and/or dim settings. The backlit graphic display device can be mounted to a structure or surface, such as a vehicle window or a building window, to allow theme graphics, such as words, logos and/or symbols, to be highly visible, for example during low visibility weather and/or driving conditions.

In other embodiments according to this invention, the backlit graphic display device can be used to display the appearance of a moving image. For example, a light film or backlit graphic display device according to the present invention can be used to display a dynamic or moving flag, to give the appearance that the flag is blowing in the wind. The creation or animation of a moving image can be accomplished with an EL panel having two or more segments that are positioned adjacent with respect to each other. A controller can be used to vary power delivered to each segment. For example, each segment can be individually controlled to dim, brighten, pulse off and on, switch off and/or switch on, for different desired effects.

In some instances, product according to this invention, when introduced into the marketplace, should conform to local regulations, such as a variety of U.S. Federal and U.S. State transportation regulations regarding lumen output levels, animation effects and product positioning or placement on a vehicle. A dim switch or control feature may allow a lumen output level to be adjusted to within or to not exceed one or more set regulations. This feature or adjustment can occur manually or automatically. A mode switch feature can ensure that a final use falls within or meets regulations. The product configuration may allow mounting on a side window or a back window of a vehicle, for example, depending on an intended use.

A product of this invention may be easy to use, require low maintenance and operate within control module settings and functional parameters. For example, a motion sensor, a light sensor and/or a timer switch can be used to make all necessary or desired adjustments, so that the user does not have to use or address the on/off switch once a desired operational mode is set. The user may have an option to change a mode setting. A battery recharge capability, particularly if automatic, allows the user to not be concerned with replacing or manually recharging batteries. A removable battery module provides a simple battery replacement operation. A flexible mounting adaptation and a DC adaptor with a control module allow easy installation. A battery pack does not require auto wiring operation for easier installation.

A product according to this invention can be manufactured and operate within a range of reasonable costs, based on potential market applications. An interchangeable translucent graphic panel and layer assembly allows the EL component to be standardized as white backlight. Thus, custom printing of clear plastic sheet material minimizes the cost, the inventory and the production time. Sensors optimize product function, provide a user-friendly product and prolong battery life during use. There can be a battery recharge capability with, for example a solar panel option, to prolong battery life. A vehicle DC port and adapter/control module allows use of the device without batteries.

With a product according to this invention, consumers may obtain value added attributes of increased visibility for their specific needs. Also, the consumer is able to use the backlit graphic display device of this invention, if necessary within legal vehicle guidelines, and benefit from improved user features and cost effective operation. The backlit graphic display device of this invention can include a static or constant display or illumination and/or a dynamic or animated graphic display or illumination, and can also include two or more graphics panels. The backlit graphic display device of this invention can be used for any suitable application other than vehicular applications, such as for signage in a home window or in a business or store-front window.

Other readily identifiable objects and structural features of the present invention will become more evident from a consideration of the drawings submitted in support of these specifications as briefly summarized hereinafter.

BRIEF DESCRIPTION OF THE DRAWINGS

Other features of my invention will become more evident from a consideration of the following brief descriptions of patent drawings.

DETAILED DESCRIPTION OF THE PREFERRED EMBODIMENT

Figure 1:
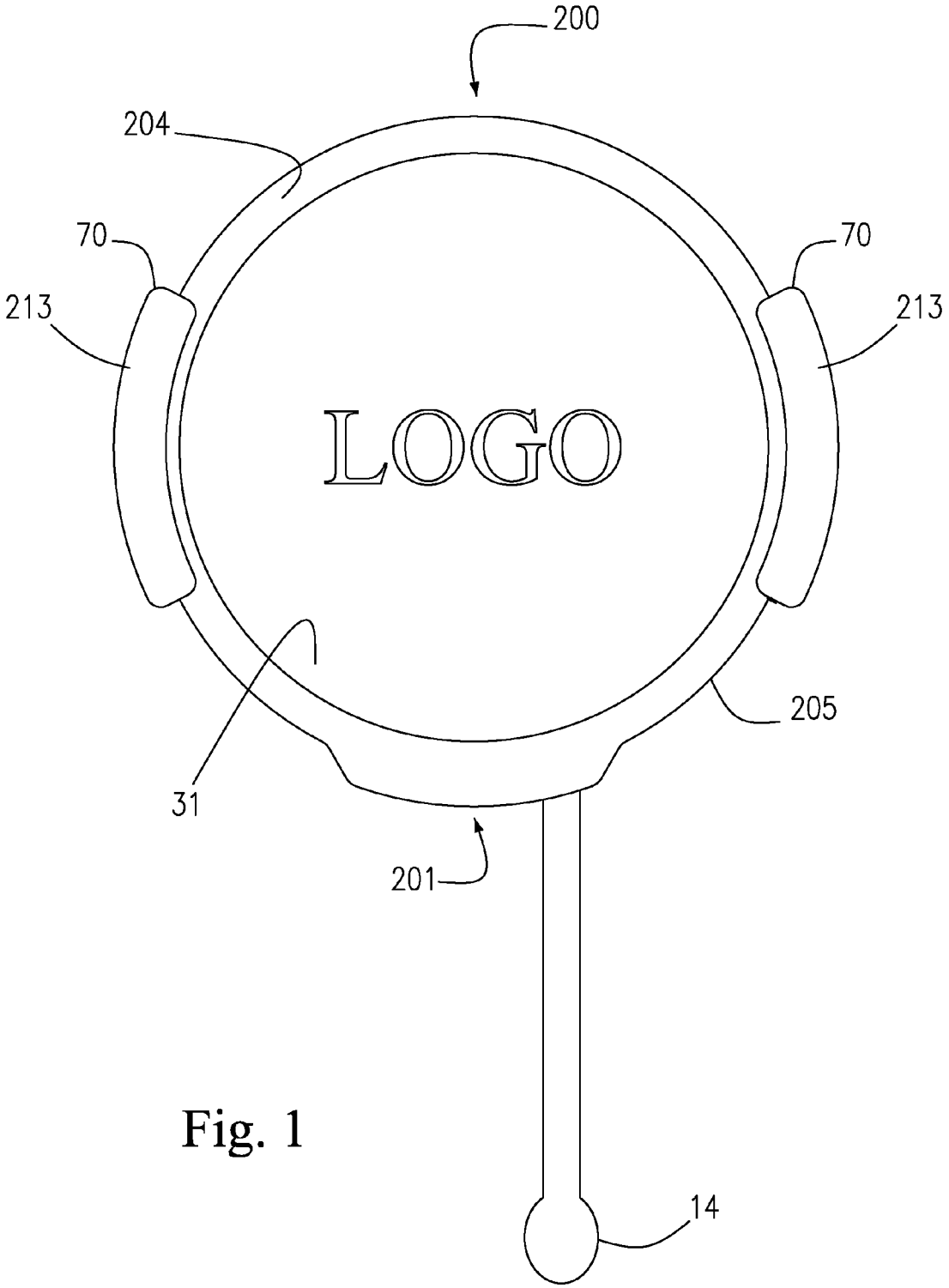
FIG. 1 is a frontal or anterior view of a first backlit graphic display device according to the present invention showing laterally opposed device-to-surface mounts.

The present invention provides a backlit graphic display device as depicted and referenced at 10. The backlit graphic display device 10 according to the present invention preferably and essentially functions to illuminate interchangeable graphic panels or graphic lenses as at 31. To achieve this primary objective, the backlit graphic display device 10 according to the present invention preferably and essentially comprises a housing assembly, a light source assembly, a light guide assembly, and certain especially formed device-to-surface retainer structures or mounts as at 70.

The housing assembly preferably and essentially comprises a housing top as at 200, a housing bottom as at 201, laterally opposed housing sides as at 202, a housing back section as at 203, a housing front section as at 204, and peripheral housing edging 205 (as preferably defined by the housing front section 204). The housing edging 205 may be formed in any number of shapes, including but not limited to circular shapes as generally depicted in FIGS. 1-5, 11A and 11B, or may be substantially rectangular as generally depicted in FIGS. 6-10C.

The housing back 203 preferably and essentially comprises an assembly-receiving cavity or void as at 206 and a battery-receiving compartment 15. The battery-receiving compartment may be outfitted with a compartment cover as at 16. The peripheral housing edging 205 preferably and essentially defines a panel-receiving section or volume in anterior adjacency to the assembly-receiving cavity 206. The light source assembly preferably and essentially comprises, in electrical communication, a power source as exemplified by one or more batteries 40; a light source as exemplified by LED type light elements; and circuitry as exemplified by conductor(s), terminals, a PC board, a control module, and an optional, manually operable switch as at 14, and an on/off/mode switch as at 17. Portions of the light source assembly are preferably receivable in the assembly-receiving cavity 206, and the light source(s) or LED's are preferably received radially adjacent the peripheral housing edging 205 and fit within the source-receiving notches 11 formed in portions of the light guide assembly.

The light guide assembly preferably comprises a light guide panel or light guide as at 96 is positionable in anterior adjacency to the assembly-receiving cavity 206, the power source 40, and circuitry (received in the assembly-receiving cavity 206) and in edge adjacency to the light source(s) (preferably received in the notches 11) as exemplified by one or more LED's for guiding light emanating from the light source in an anterior direction as at 219, which anterior direction 219 is orthogonal to a light guide plane of the (planar) light guide 96.

The light guide assembly according to the present invention may further preferably and essentially comprise a light trap as at 208, which light trap 208 is preferably positionable in anterior adjacency to the light guide 96 within the panel-receiving section or volume for enhancing uniform light transmission from the light guide 96. The light trap 208 also preferably comprises notches 12 akin to notches 11 for receiving the light source constructions. The notches 12 are aligned with the notches 11 for aiding positioned placement of the light trap 208 in anterior adjacency to the light guide 96.

Figures 10A, 10B, 10C:
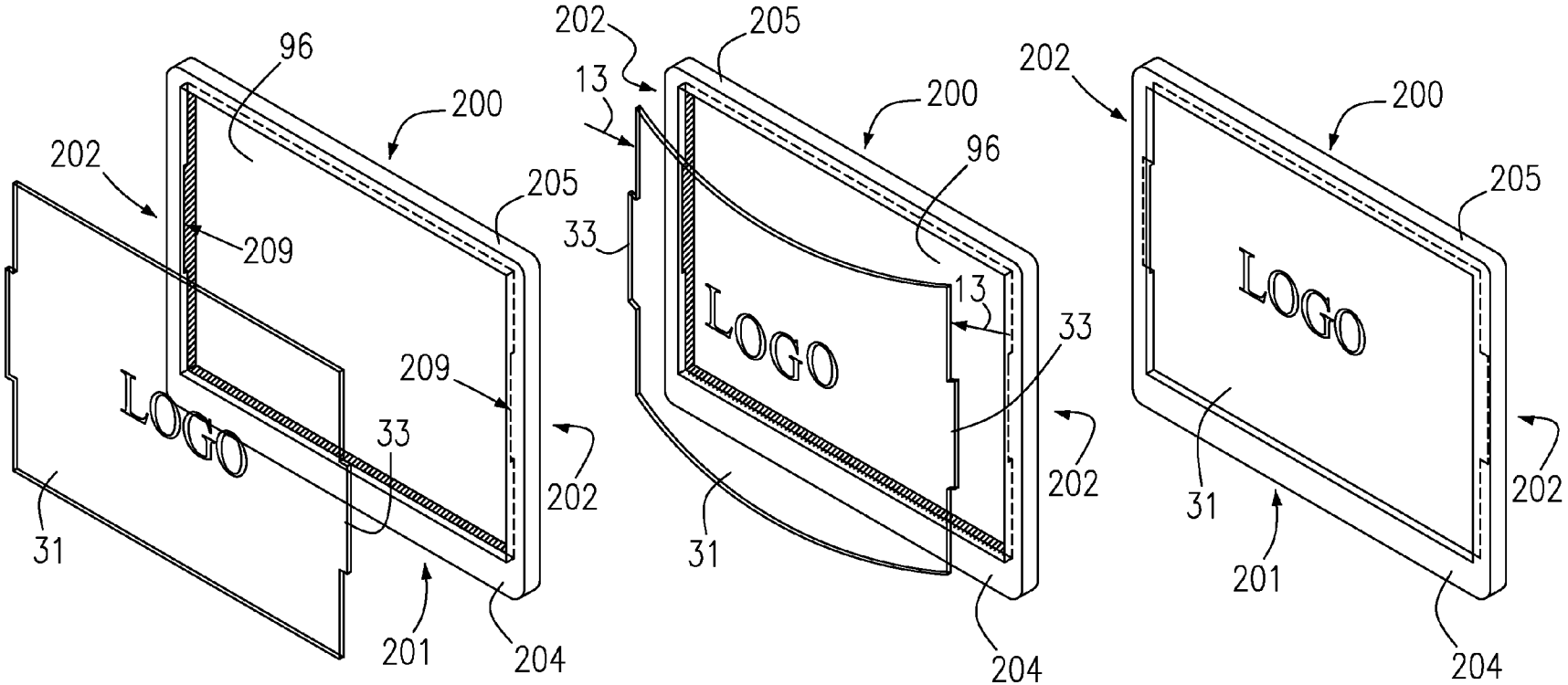
FIG. 10A is a first sequential frontal top perspective view of a planar generic graphics panel exploded from a backlit graphic display assembly according to the present invention showing wing-receiving slots formed in the backlit graphic display assembly for receiving laterally opposed wings formed on the graphics panel.
FIG. 10B is a second sequential frontal top perspective view of a bent generic graphics panel exploded from the backlit graphic display assembly according to the present invention showing wing-receiving slots formed in the backlit graphic display assembly for receiving laterally opposed wings formed on the graphics panel.
FIG. 10C is a third sequential frontal top perspective view of the planar generic graphics panel assembled to the backlit graphic display assembly such that the wing-receiving slots formed in the backlit graphic display assembly have received the laterally opposed wings formed on the graphics panel.
Figure 11B:
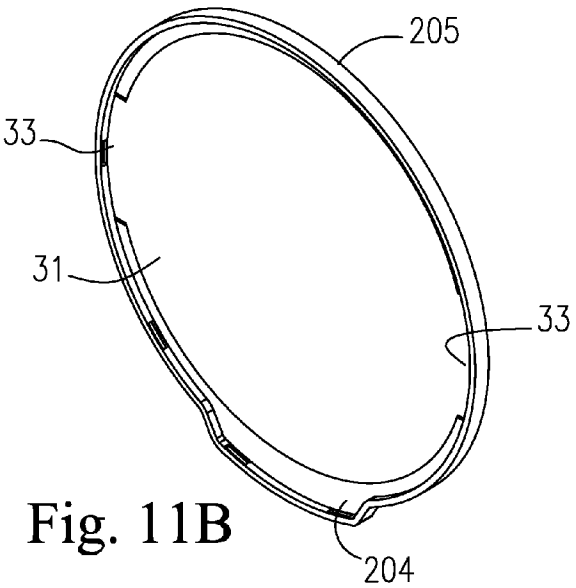
FIG. 11B is a rear top perspective view of the anterior housing section and the generic graphics panel in an assembled state, laterally opposed wings formed on the generic graphics panel being received in wing-receiving openings formed in the anterior housing section.
Figure 11A:
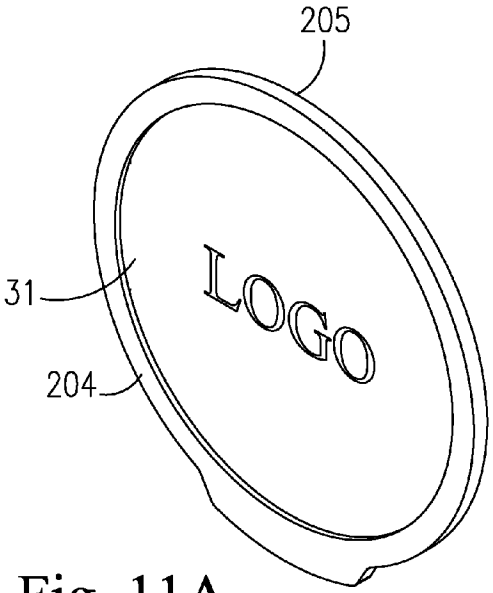
FIG. 11A is a frontal top perspective view of an anterior housing section and a generic graphics panel in an assembled state.

The primary function of the backlit graphic display device 10 is to illuminate a graphic lens or graphic panel 31 with light directed anteriorly as at 219. In this regard, the device may preferably comprise, in combination, an interchangeable graphic lens as at 31. The graphic lens 31 may preferably and essentially comprise laterally opposed wings or tab structures as at 33. The wings or tab structures 33 are receivable at inner portions of the housing edging 205. The housing edging 205 preferably comprises laterally opposed tab-receiving voids as at 209 for receiving said tab structures 33 and thus for removably retaining the graphic lens 31 in anterior adjacency to the light guide 96 as generally depicted in FIGS. 10A-10C.

The graphics panel 31 as depicted in the illustrations appended to these specifications is provided or outfitted with a generic term LOGO as representative of the types of visual information that may be displayed upon the graphics panel 31. Referencing FIGS. 10A through 10C, the reader will note that the wings or tab structures 33 are insertable into the voids 209 preferably by bending (as at 13) the otherwise planar graphics panel 31 so as to narrow the lateral spacing between the wings or tab structures 33. Once the tab structures 33 are properly aligned with the voids 209 following the bending action, the material construction of the graphics panel 31 may be relaxed thereby broadening the lateral spacing between the tab structures 33 and enabling insertion of the tab structures 33 into the voids 209.

Central to the practice of the present invention are the device-to-surface retainer structures or mounts as at 70. The device-to-surface retainer structures or mounts 70 are preferably and essentially laterally opposed relative to the housing assembly for fastening the backlit graphic display assembly 10 to a mounting surface as exemplified by a vehicular window 100.

The device-to-surface retainer structures 70 each preferably comprise an edge-receiving opening or void as at 207. The edge-receiving voids 207 receive and bind to or retain the laterally opposed portions of the peripheral housing edging 205 as at portions 202. The retainer structures 70 thus function to both receive and support the housing assembly such that the light from the light source(s) is guided in the anterior direction 219, which direction is orthogonal to a plane of a mounting surface as exemplified by a vehicular window as at 100.

The mounts 70 are preferably outfitted with adhesion elements or layers as at 32, which adhesion elements or layers 32 comprise a first surface that adhesively contacts a surface of element 70, and a second surface that adhesively contacts a support or mounting surface, such as a business front window, a door window or a vehicle window 100. Adhesion elements or layers 32 can be of any suitable clear or translucent adhesive.

Adhesion elements 32 may include a suitable adhesive component or layer to removably secure the backlit graphic display device 10 to the mounting surface 100 so that backlit graphic display device 10 is securely mounted to the mounting surface when in use, but can be selectively removed from the mounting surface without damage to adhesion element 32 and/or the mounting surface. It is contemplated, however, that other suitable components, such as suction cups, brackets, other adhesives, static cling devices, screws, wire, hook-and-loop fasteners and/or any other mechanical, electrical and/or magnetic connector can be used to mount backlit graphic display device 10 with respect to a mounting structure or surface 100.

The backlit graphic display device 10 may further preferably and essentially comprise a housing back 203 that comprises integrally formed, laterally opposed, posteriorly extending retainer-engaging projections or protuberances as at 210. The retainer-engaging projections or protuberances 210 essentially function as stop structure for engaging upper rearward portions 211 of the retainer structures 70. The retainer-engaging projections 210 and retainer structures 70 enhance support of the housing assembly adjacent the mounting surface 100.

Figure 2:
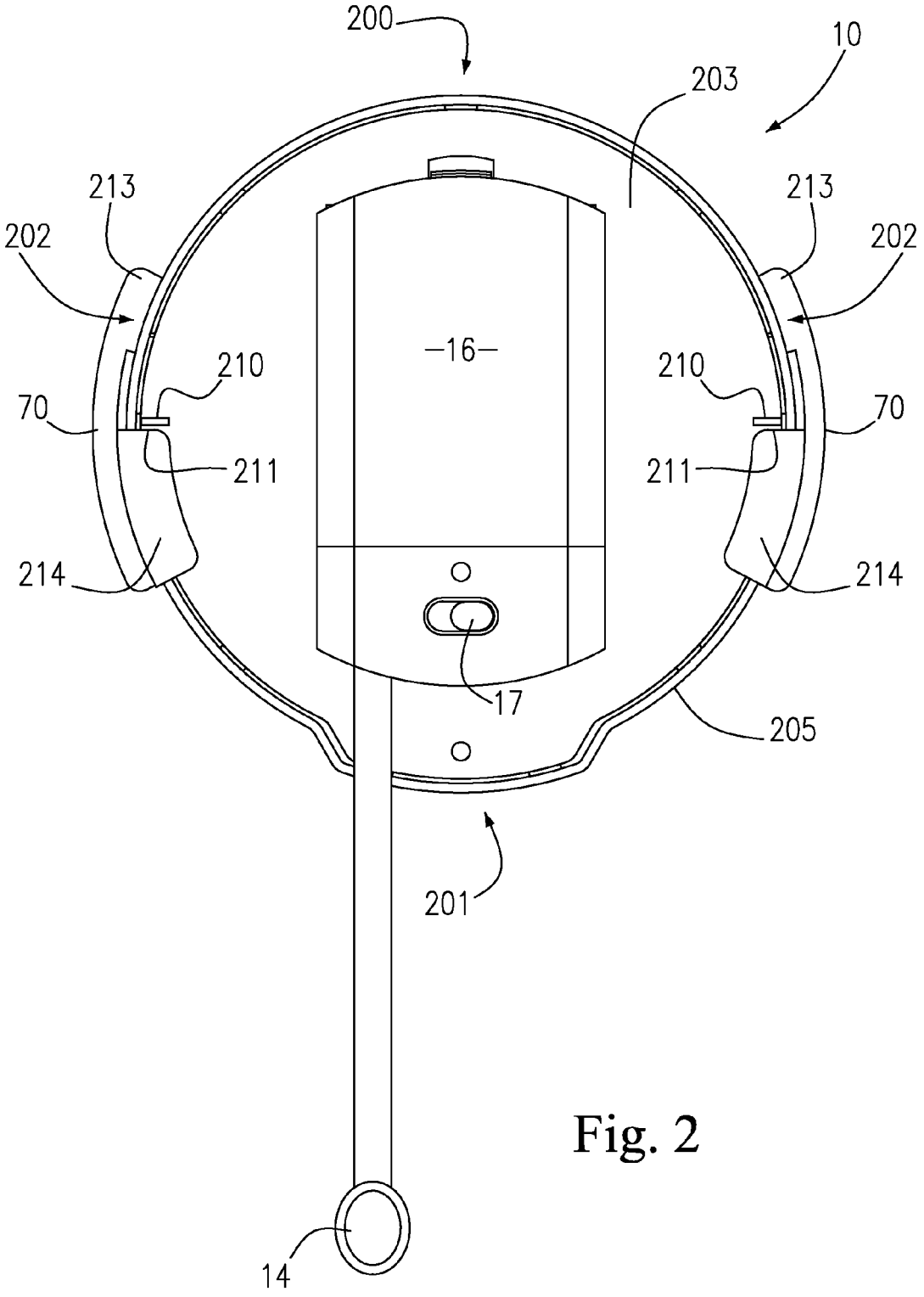
FIG. 2 is a rear or posterior view of the first backlit graphic display device according to the present invention showing laterally opposed device-to-surface mounts.
Figures 3, 3A:
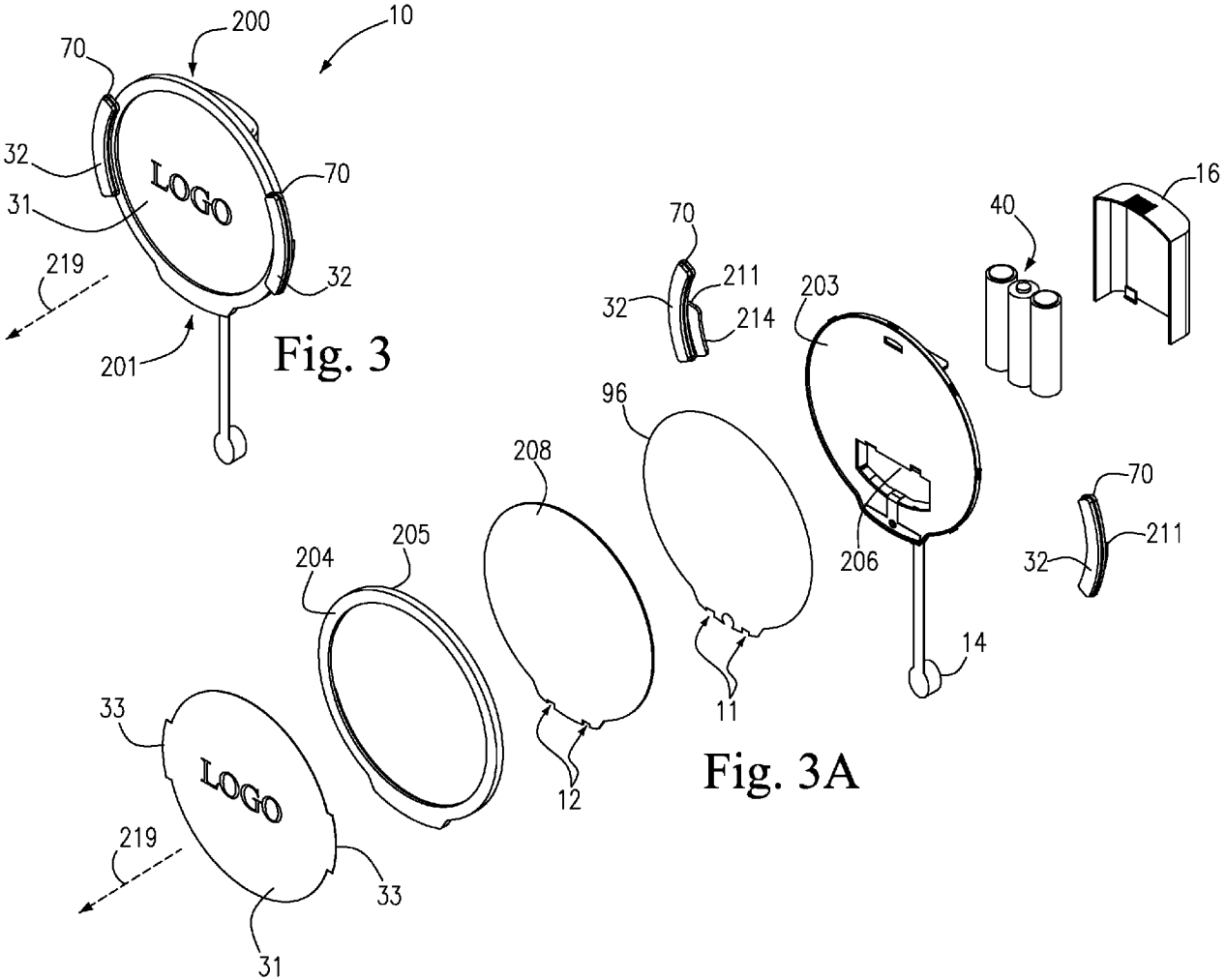
FIG. 3 is a reduced first frontal top perspective view of the first backlit graphic display device according to the present invention in a fully assembled state showing laterally opposed device-to-surface mounts.
FIG. 3A is a reduced frontal exploded top perspective view of the first backlit graphic display device according to the present invention shown in an exploded state in side-by-side relation to FIG. 3 for comparative purposes.
Figures 4, 4A:
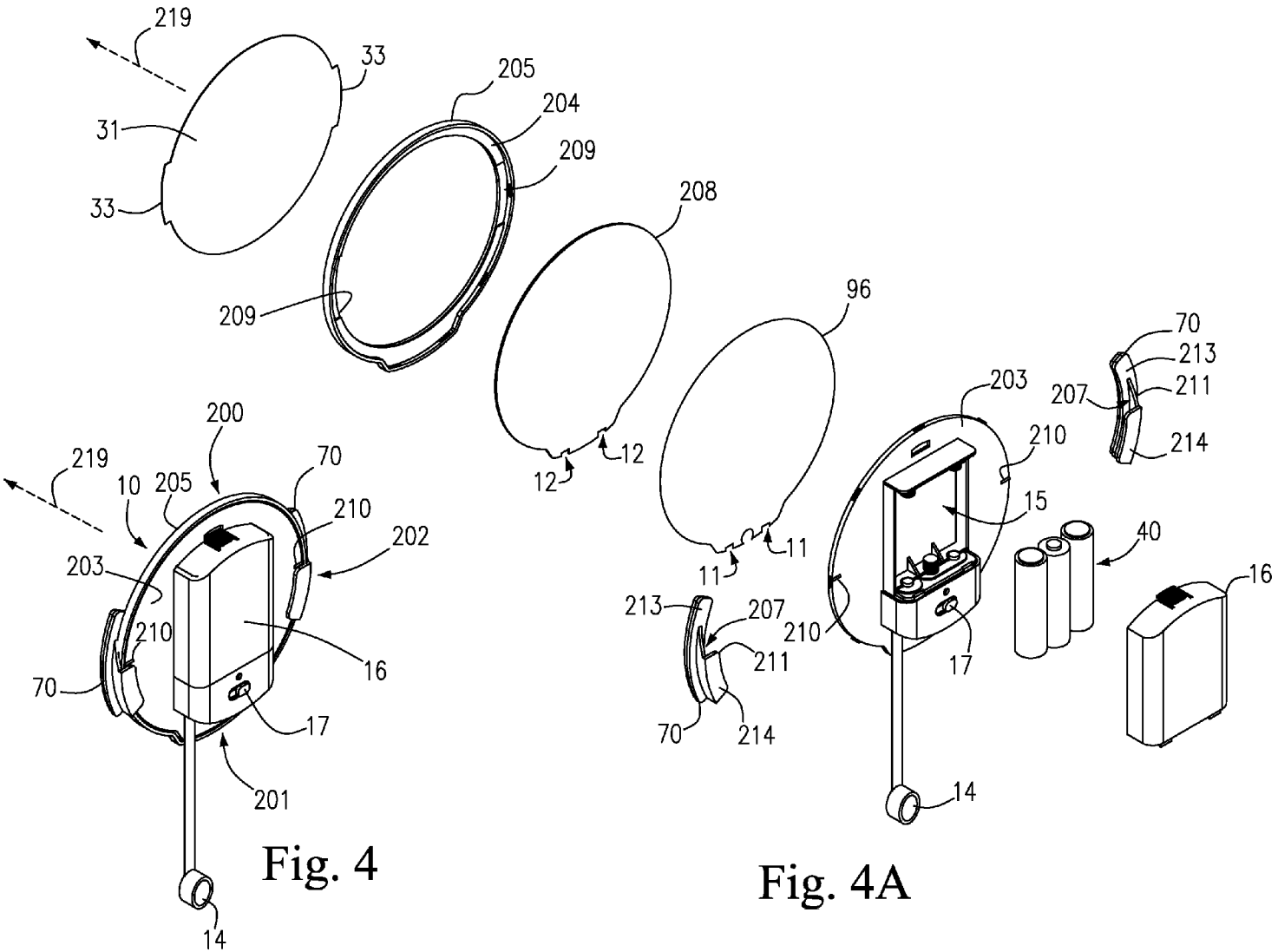
FIG. 4 is a reduced rear top perspective view of the first backlit graphic display device according to the present invention in a fully assembled state showing laterally opposed device-to-surface mounts.
FIG. 4A is a reduced rear exploded top perspective view of the first backlit graphic display device according to the present invention shown in an exploded state in side-by-side relation to FIG. 4 for comparative purposes.
Figure 5:
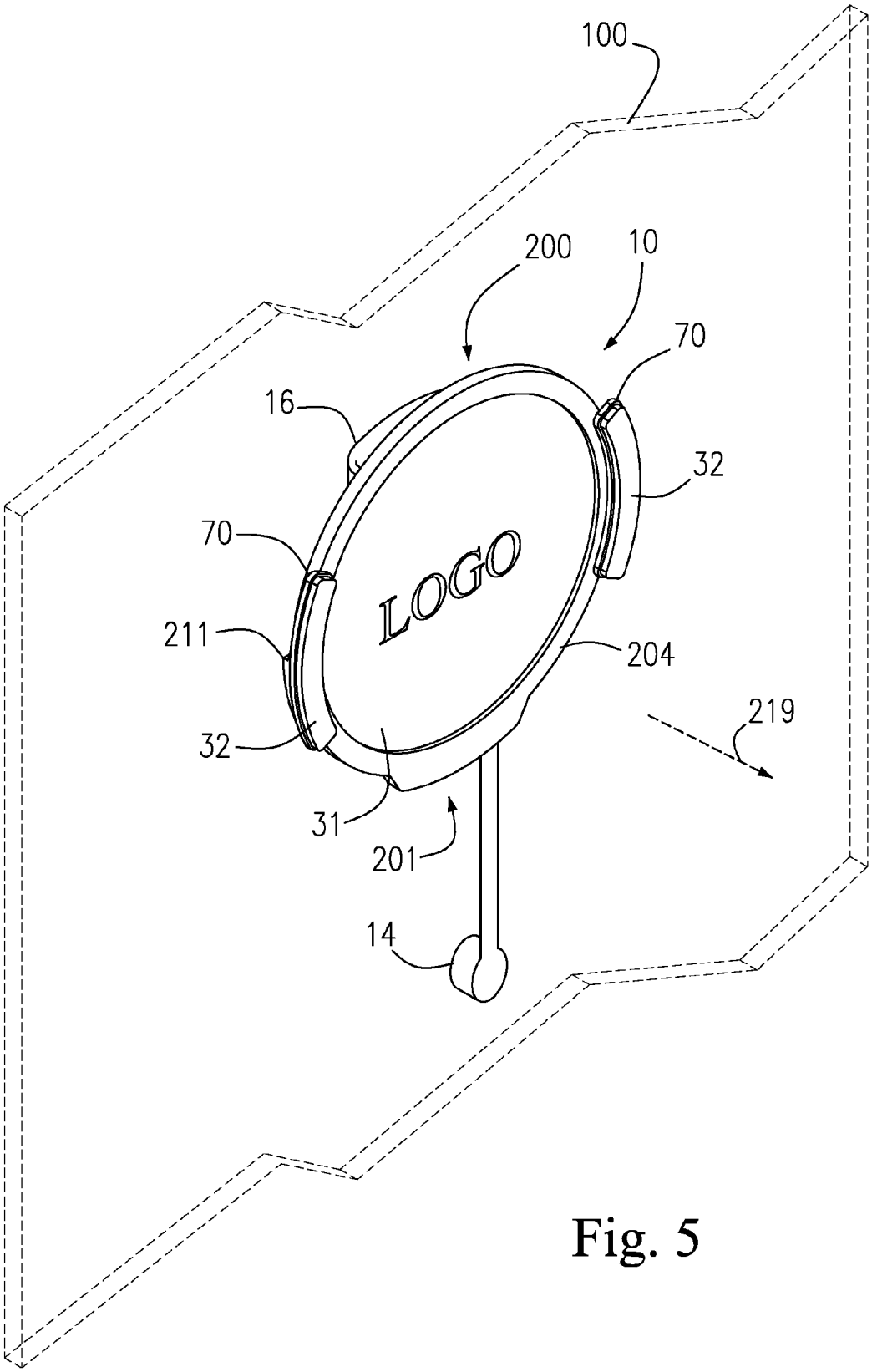
FIG. 5 is a second frontal top perspective view of the first backlit graphic display device fastened to a fragmentary phantom type mounting surface as exemplified by a vehicular window via laterally opposed device-to-surface mounts.
Figure 6:
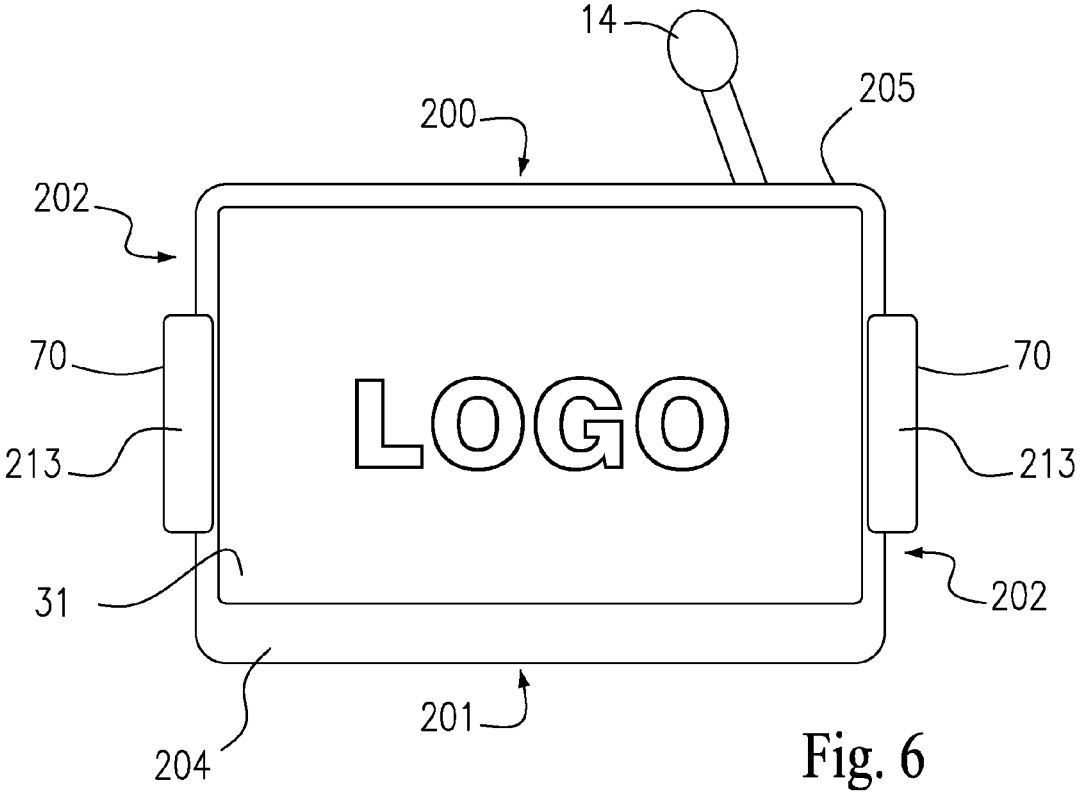
FIG. 6 is a frontal or anterior view of a second backlit graphic display device according to the present invention showing laterally opposed device-to-surface mounts.
Figure 9:
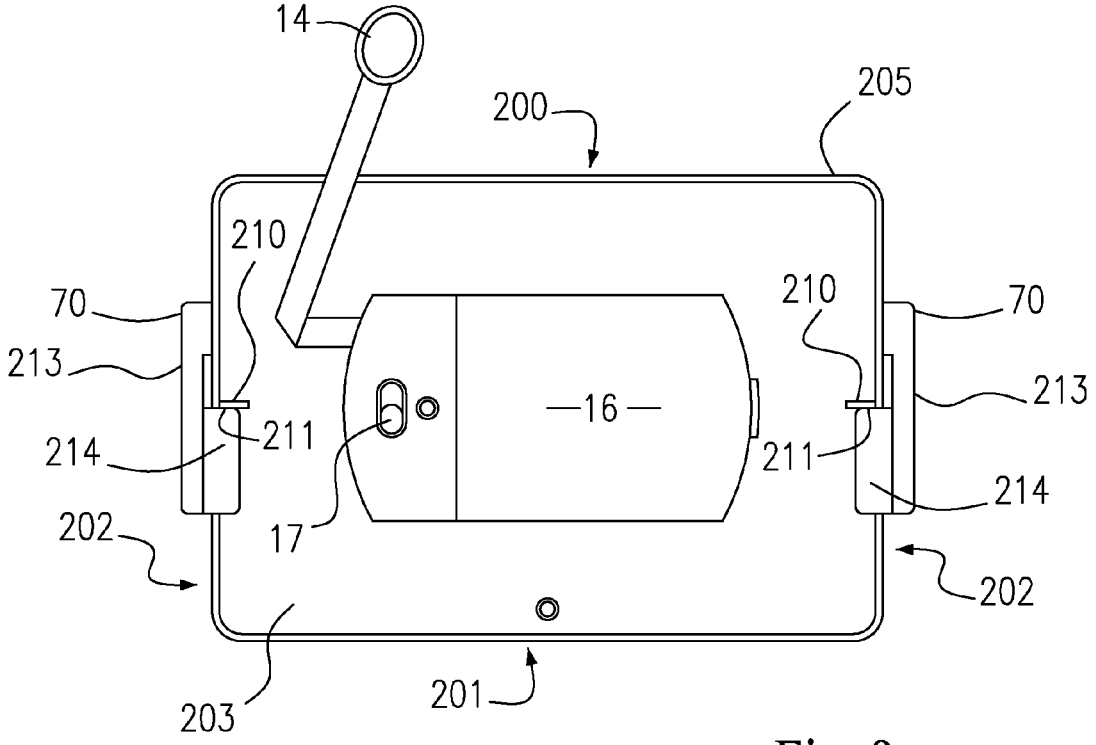
FIG. 9 is a rear or posterior view of the third backlit graphic display device according to the present invention showing laterally opposed device-to-surface mounts.

The retainer-engaging projections or protuberances 210 may preferably be formed at a point substantially equidistant intermediate the housing top 200 and the housing bottom 201 of the housing assembly as generally depicted in FIGS. 2 and 9. The described equidistant placement of the projections or protuberances provides for better balance of the device 10 when mounted to the mounting surface 100, and thus is believed to enhance support of the housing assembly adjacent the window or mounting surface 100.

Figure 7:
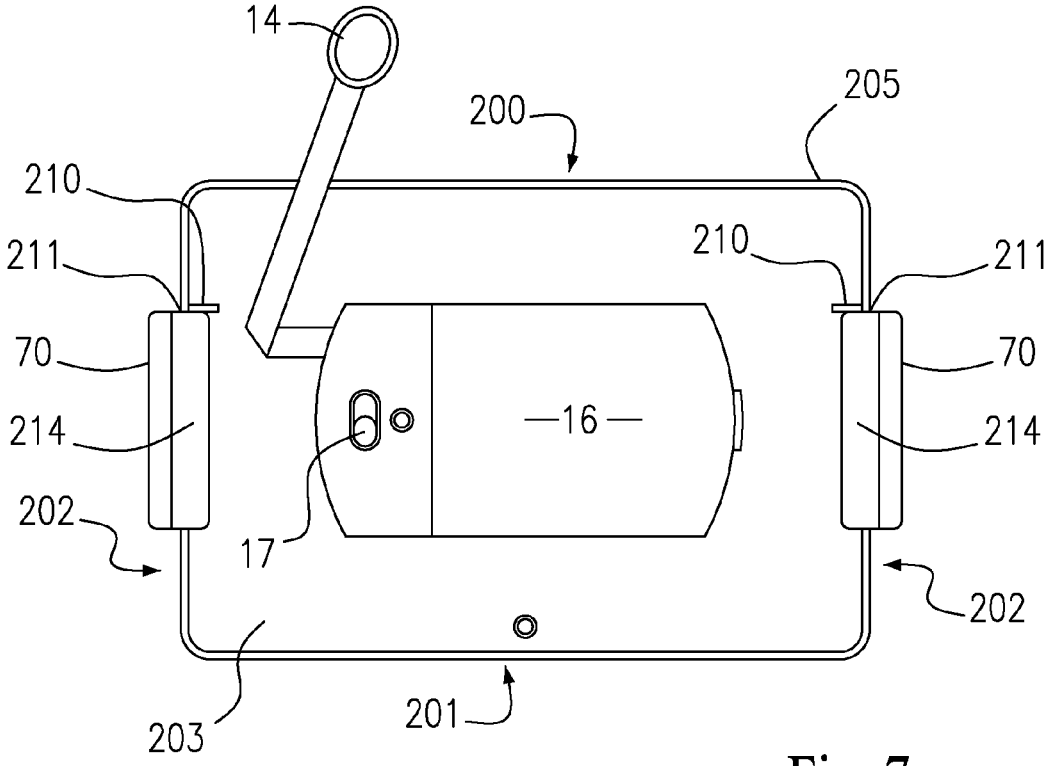
FIG. 7 is a rear or posterior view of the second backlit graphic display device according to the present invention showing laterally opposed device-to-surface mounts.
Figure 8:
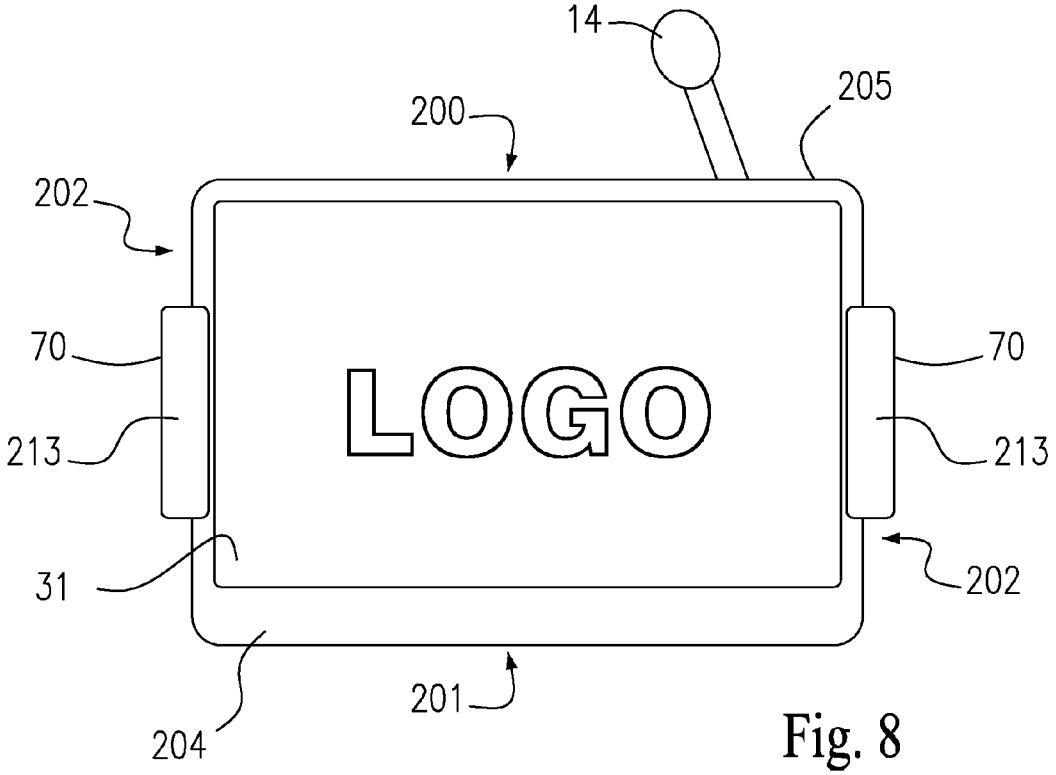
FIG. 8 is a frontal or anterior view of a third backlit graphic display device according to the present invention showing laterally opposed device-to-surface mounts.

Alternative placements of the projections or protuberances 210 may be nearer the housing top 200 than the housing bottom 201 as generally depicted in FIG. 7. Alternative placements of the projections or protuberances 210 coincide with alternative construction(s) of the retainer structures or mounts 70 as discussed in more detail hereinafter.

The backlit graphic display device 10 according to the present invention preferably comprises retainer structures or mounts 70 that comprise or incorporate a frontal or anterior retainer structure or portion as at 213 that differs in length as compared to a rear or posterior retainer structure or portion as at 214. The preferred construction of retainer structures or mounts 70 incorporates a relative greater length anterior portion 213 and a relative shorter length posterior portion 214 as generally depicted in FIGS. 2 and 9. From a comparative inspection of FIGS. 2 and 9 versus FIG. 7, it will be seen that an alternative construction of the retainer structures or mounts 70 incorporates a posterior retainer structure or portion 224 that is substantially the same length as the anterior retainer structure or portion 213.

The preferred construction of a relatively longer anterior retainer portion 213 and a relative shorter posterior retainer portion 214 is used in combination with projections or protuberances 210 that are formed equidistant intermediate the housing top 200 and the housing bottom for providing better balance of the device 10 when mounted to the mounting surface 100. The relatively longer anterior retainer portions 213 are preferably located substantially equidistant intermediate the housing top 200 and the housing bottom 201 so as to provide both better balance anteriorly and better symmetry for passersby or onlookers of the backlit graphic display device 10 when mounted to a mounting surface 100. The relatively shorter posterior retainer portions 214 are preferably located in inferior adjacency to the projections or protuberances 210 formed equidistant intermediate the housing top 200 and housing bottom 201. The relatively shorter posterior retainer portions 214 are located in inferior adjacency to the substantially equidistant projections 210 for providing inferior and posterior or cradled support to the device 10.

When formed in connection with a substantially circular housing assembly as generally depicted in FIGS. 1-5, the anterior retainer structure portions 213 extend in laterally opposed arc lengths, which laterally opposed arc lengths are substantially equidistant intermediate the housing top 200 and the housing bottom 201 for enhancing support of the housing assembly 26 adjacent the mounting surface 100. The retainer structures 70 each preferably extend an arc length (cooperable with the substantially circular peripheral housing edging 205) toward the housing bottom 201 from the housing sides 202. The peripheral housing edging 205 is thus seatable in and upwardly supportable by medially extending upper rearward portions 211 of the posterior retainer structures or portions 214 of the laterally opposed retainer structures 70.

As indicated, the backlit graphic display device 10 can be mounted with respect to a mounting surface window, such as vehicle window 100, to display desired graphics for marketing applications, safety applications and/or emergency situations, for example. The backlit graphic display device 10 according to the present invention can provide highly visible graphics that other motorists and/or pedestrians or bystanders will be able to see in adverse weather conditions and/or adverse driving conditions, for example.

In one embodiment of this invention, a pocket approach or arrangement can use molded plastic opaque walls, when viewed from a top direction to see a shape of particular artwork segments that can partition off LED lighted segments, such as with walls, panels and/or structural baffles. An LED structure can be mounted on, with respect to and/or directly to a board, such as wired, soldered or otherwise electrically connected and/or mounted to a PC board, and positioned near, for example beneath each segment. The LED structure can be pressed into or otherwise positioned or mounted with respect to a pocketed light diffuser, for example a clear or translucent etched plastic, in a desired shape of the segment.

In another embodiment according to this invention, to accomplish an evenly distributed lighting, segments of the wall structure can be molded into different shapes, such as art shapes. The segment shapes can be injection molded plastic, for example, with or without etching to provide a textured outer surface which can but need not be back painted with a white or non-white paint or other similar material. LED structures can be fixed, mounted and/or positioned adjacent or near an edge of the segment, to distribute light into the segment. Edge lighting can help implement different intricate or complex graphic designs.

When the illuminated graphics panel of this invention is constructed with LED structures, the overall dimensions will typically be greater than a similar product manufactured with one or more EL elements. The LED structure requires increased segment material to more evenly distribute light for each graphic segment, which can result in added thickness of the panel to achieve better light distribution, depending upon the particular use. However, if costs associated with the LED technology are or become low enough, there can be a significant market demand for the LED technology.

Preferably but not necessarily, each element surface or another suitable portion of each element is positioned with respect to a surface or another suitable portion of an adjacent element of light film component. For example, elements of light film component can be in surface-to-surface contact with adjacent or nearby elements of light film component. An interchangeable panel, such as a tinted translucent panel, can be positioned to mount between EL element and the surface to which housing is mounted, such as window. An interchangeable translucent graphic panel having a layered assembly allows EL element to be standardized, for example as white backlight, and thus custom printing on clear plastic sheet material can be used to reduce costs, inventory and/or production time.

As indicated above, in certain embodiments of this invention, the elements of backlit graphic display device 10 can have any suitable overall and/or cross-sectional shape and/or can be configured in any suitable relationship. It is possible to provide a layered configuration wherein each element layer is laminated, such as during manufacture or construction, to preferably but not necessarily produce an apparatus or device having a relatively slim design. It is also possible to provide a backer plate configuration, wherein elements are integrated with, affixed to and/or connected to a backer plate, such as an injection molded backer plate. It is also possible to provide a backer housing configuration, wherein elements are integrated with, affixed to and/or connected to a module, such as an injection molded module. In each configuration, subassemblies can be mounted at any suitable location to dedicated or available surfaces, including any suitable vehicle surface.

In certain embodiments of this invention, backlit graphic display device 10 may include any number of the components discussed in this and previous specifications that have been incorporated herein by reference thereto, in addition to other suitable or interchangeable components known to those skilled in the art. For example, the on/off switch 17 can providing multiple position switching including an off position, a motion-on position, a motion-off position, and/or a constant operation position. Mode switch 17 can be used to select a position that operates backlit graphic display device 10 within any necessary regulation or limited parameter.

The device 10 may be preferably outfitted with various sensors, including a dim switch or sensor, a motion sensor, and/or a light sensor. The dim switch or sensor can include settings to adjust a lumens output level, as desired, for example to conform to any local ordinance, such as vehicle regulations within a particular jurisdiction. The motion sensor can comprise any suitable sensor, such as a spring-type sensor, a rocker-type sensor, an accelerometer, a speedometer, a directional sensor and/or a position sensor. The light sensor preferably communicates with control module to provide appropriate power for proper operation of backlit graphic display device 10, depending upon the time of day and/or weather conditions, such as darkness, cloudiness, rain, snow and/or fog.

The control module can be interfaced with any suitable position identifying device, such as a Global Positioning System device. As used throughout this specification and in the claims, the phrase position identifying device is intended to be interchangeable with the phrase Global Positioning System device, and is also intended to be interchangeable with any other suitable mechanical and/or electrical device that identifies a position or location of backlit graphic display device 10 according to this invention. In certain embodiments of this invention, control module can be programmed to adjust any controllable parameter of backlit graphic display device 10, such as a lumens output level.

With such adjustment capabilities, backlit graphic display device 10 of this invention can be used to manually or automatically identify a position and conform to local ordinances or regulations. Some local areas may require a minimum and/or a maximum lumens output level, which control module can identify and deliver as an output signal to any controllable component of backlit graphic display device 10. In addition, if any local area prohibits, use of backlit graphic display device 10 according to this invention, the control module can be programmed to automatically shut down or turn off backlit graphic display device 10.

In certain embodiments of this invention, the control module can evaluate each sensed signal, process each sensed signal according to programmed steps, and then emit one or more output signals, each of which can include information, for example information to set a power rate at zero, partial power or full power. In one embodiment of this invention, an internal timer switch can work or cooperate with motion switch and activate at least one illumination switch to an on position, an off position or a partially powered position, after a determined time period has passed, for example a five (5) minute time period, based on a manual and/or an automatic mode determination and setting. The backlit graphic display device 10 can also include a sound or noise sensor, a vibration sensor and/or a temperature sensor or switch.

Backlit graphic display device 10 can be constructed to achieve specifically desired illuminated graphics in a user-friendly manner, the extent to which can be a function of the programming of the control module. In certain embodiments of this invention, backlit graphic display device 10 requires relatively little user input and can be used to achieve the display of critical information, such as safety and hazard information, as well as non-critical information, such as identifying membership in an organization or providing a graphic message.

The housing can be permanently or detachably secured with respect to any mounting surface, such as a glass window and/or a vehicle surface. In certain embodiments according to this invention, housing is detachably secured with a hook and loop fastener, such as a VELCRO® brand hook and loop type fastening means, and/or any suitable mechanical connector. In other embodiments according to this invention, double sided tape or another suitable adhesive, such as glue or adhesion strips as exemplary for the adhesion elements 32 can be used to attach housing with respect to the mounting surface 100 via the mounts 70.

In other embodiments according to this invention, the housing can be removably mounted using suction cups structurally attached to or with respect to housing. For example, tabs or other inserts can be mounted within any corresponding void to secure housing with respect to a suction cup. Plates, including wafer plates and die stamp thin metal plates, or injection molded plates or other shapes, can be used to mount or otherwise fasten housing with respect to the mounting surface 100. Magnetic plates can also be used to mount housing with respect to the mounting surface 100 via the mounts 70.

While the above description contains much specificity, this specificity should not be construed as limiting the scope of the invention, but rather as an exemplification of the invention. In this last regard, it is contemplated that the present invention can be used for a variety of applications including, but not limited to, safety signals, public service symbols, such as the Department of Transportation, the Military, the National Guard, the Police and the Fire Department logos or plaques, construction locations and workers, zone authorities, help/warning messages, and other suitable informational and/or marketable applications, such as zone parking passes for major events, promotional icons, vehicle brand logos, animated images, dynamic images, wave images, and advertising messages.

Throughout these specifications, the phrase illuminated graphics panel, the phrase electroluminescent display device, the phrase electroluminescent display, the phrase electroluminescent device and the phrase electroluminescent element, the phrase light emitting diode (LED), the phrase lighting device, the phrase lighting apparatus, as well as other similar phrases, are intended to be interchangeable with each other. The phrase illuminated graphics panel or any of the other interchangeable phrases each is intended to relate to a lighting device that includes panel shaped elements or segments which can be lit by any suitable light supply or source. The phrase illuminated graphics panel and the interchangeable phrases are also intended to relate to and include currently available EL lighting devices, as well as EL devices or other suitable lighting devices that may become available.

In certain embodiments of this invention, the illuminated graphics panel may be designed and/or manufactured with light emitting diode (LED) technology, which can provide cost savings. Any suitable type of LED can be used, including but not limited to a pointing LED, a wide beam LED, a side firing LED and/or an organic LED (OLED). For example, it may be possible to diffuse LED lights into panels, dedicated panels and/or dedicated panel segments, which can be of any suitable material and have any suitable dimensions, cross section and/or shape.

The present invention may be said to preferably and essentially provide a (backlit) graphic display device for illuminating interchangeable graphic panels, which backlit graphic display device preferably and essentially comprises a housing assembly, a light source assembly, a light guide assembly, and device-to-surface fastening means as exemplified by the retainer structures or mounts 70 specified hereinabove.

The housing assembly 26 preferably and essentially comprises a housing top as at 200, a housing bottom as at 201, laterally opposed housing sides as at 202, a housing back as at 203, a housing front as at 204, and a substantially circular peripheral housing edging 205. The housing back 203 preferably and essentially comprises an assembly-receiving cavity or void as at 206, and the peripheral housing edging 205 preferably and essentially defines a panel-receiving section in anterior adjacency to the assembly-receiving cavity 206.

The light source assembly preferably and essentially comprises, in electrical communication, a power source; a light source as exemplified by LED type light elements; and circuitry as exemplified by conductor(s), terminals, PC board, and a control module. The power source and circuitry are receivable in the assembly-receiving cavity 206, and the light source(s) is/are received radially adjacent the peripheral housing edging 205.

The light guide assembly, preferably comprising light guide panel or light guide as at 96 is positionable in anterior adjacency to the power source and circuitry and in edge adjacency to the light source for guiding light emanating from the light source in an anterior direction as at 219, which anterior direction is orthogonal to a light guide plane of the light guide 96.

The device-to-surface retainer structures as at 70 are preferably and essentially laterally opposed relative to the housing assembly 26 for fastening the graphic display device to a mounting surface as at 100. The device-to-surface retainer structures 70 each comprise an edge-receiving opening or void as at 207.

The edge-receiving voids 207 receive and bind to or retain the laterally opposed portions of the peripheral housing edging 205 as at portions 202. The retainer structures or mounts 70 thus function to both receive and support the housing assembly 26 such that the light from the light source(s) is/are guided in the anterior direction 206, which direction, as stated, is orthogonal to a plane of the mounting surface 100.

The graphic display device according to the present invention may further preferably and essentially comprise a light trap as at 208, which light trap 208 is positionable in anterior adjacency to the light guide 96 within the panel-receiving section for enhancing uniform light transmission from the light guide 96.

The graphic display device may further comprise, in combination, an interchangeable graphic lens as at 31. The graphic lens 31 may preferably and essentially comprise laterally opposed tab structures as at 33; and inner portions of the housing edging 205 may preferably comprise laterally opposed tab-receiving voids as at 209 for receiving said tab structures 33 and thus for removably retaining the graphic lens 31 in anterior adjacency to the light guide 96.

The graphic display device may further preferably and essentially comprise a housing back 203 that comprises integrally formed, laterally opposed, posteriorly extending retainer-engaging projections as at 210. The retainer-engaging projections 210 essentially function as stop structure for engaging upper rearward portions 211 of the retainer structures 70. The retainer-engaging projections 210 and retainer structures 70 enhance support of the housing assembly adjacent the mounting surface 100.

The retainer-engaging projections may preferably be formed at a point substantially equidistant intermediate the housing top 200 and the housing bottom 201 of the housing assembly for enhancing support of the housing assembly adjacent the mounting surface 100. The retainer structures 70 each preferably extend an arc length (cooperable with the substantially circular peripheral housing edging 205) toward the housing bottom 201 from the housing sides 202. The peripheral housing edging 205 is thus seatable in and upwardly supportable by medially extending portions of the laterally opposed retainer structures 70 and the retainer-engaging projections 210.

The graphic display device of claim may further comprise retainer structures 70 each comprising a frontal retainer structure portion as at 213, which frontal retainer structure portions 213 extending in laterally opposed arc lengths, which laterally opposed arc lengths are substantially equidistant intermediate the housing top 200 and the housing bottom 201 for enhancing support of the housing assembly 26 adjacent the mounting surface 100.

A graphic display device may thus be said to essentially comprise a housing assembly, a light source assembly, a light guide, and device-to-surface fastening or mounting means as exemplified by the retainer structures or mounts 70.

The housing assembly preferably comprises a housing back, a housing front, and peripheral housing edging. The light source assembly preferably comprises a power source, a light source, and circuitry. The light guide is positionable in anterior adjacency to the housing back for guiding light from the light source. The device-to-surface fastening means fasten the graphic display device to a mounting surface, and are cooperably associated with the peripheral housing edging for supporting the housing assembly such that the light from the light source is guided in an anterior direction.

The retainer structures each preferably comprise a frontal retainer structure portion and a rear retainer structure portion, the frontal retainer structure portions extending in laterally opposed frontal lengths, and the rear retainer structure portions extend in laterally opposed rear lengths, which rear lengths are preferably shorter than the frontal lengths.

The laterally opposed frontal lengths are preferably substantially equidistant intermediate the housing top and the housing bottom for enhancing support of the housing assembly adjacent the mounting surface. The laterally opposed rear lengths are preferably positioned relatively nearer the housing bottom than the housing top for enhancing support of the housing assembly adjacent the mounting surface.

In a preferred embodiment, the frontal retainer structure portions extend in laterally opposed frontal arc lengths, and the rear retainer structure portions extend in laterally opposed rear arc lengths. The rear arc lengths are substantially half the frontal arc lengths as may be seen from an inspection of FIG. 2. Together, the lower rear arc lengths and the equidistant frontal arc lengths enhance stability of the device to mounting surface retention.

Accordingly, although the invention has been described in detail in connection with certain embodiments or examples, which illustrate or simulate various aspects involved in the practice of this invention, it is to be understood that all changes that come within the spirit of this invention are desired to be protected as claimed hereinafter, and thus this invention is not to be construed as limited by example or embodiment.

I claim:

1. A graphic display device for illuminating interchangeable graphic panels, the graphic display device comprising:

a housing assembly, the housing assembly comprising a housing top, a housing bottom, laterally opposed housing sides, a housing back, a housing front, and a substantially circular peripheral housing edging, the housing back comprising an assembly-receiving cavity and laterally opposed, posteriorly extending, retainer-engaging projections, the peripheral housing edging defining a panel-receiving volume in anterior adjacency to the assembly-receiving cavity;

a light source assembly, the light source assembly comprising, in electrical communication: a power source, a light source, and circuitry, the power source and circuitry being receivable in the assembly-receiving cavity, the light source being received radially adjacent the peripheral housing edging;

a light guide assembly, the light guide being positionable in anterior adjacency to the power source in edge adjacency to the light source for guiding light from the light source in an anterior direction orthogonal to a light guide plane of the light guide; and laterally opposed device-to-surface retainer structures for fastening the graphic display device to a mounting surface, the device-to-surface retainer structures each comprising an anterior retainer portion, a posterior retainer portion, and an edge-receiving void intermediate the anterior and posterior retainer portions, the edge-receiving voids for binding to laterally opposed portions of the peripheral housing edging, the anterior retainer portions each having an anterior portion length, the posterior retainer portions each having a posterior portion length and an upper rearward portion, the upper rearward portions for supporting the housing assembly via the posteriorly extending, retainer-engaging projections, the posterior portion lengths being abbreviated relative to the anterior portion lengths for enhancing stability of the housing assembly as supported by the device-to-surface retainer structures, the device-to-surface retainer structures for supporting the housing assembly such that the light from the light source is guided in the anterior direction, the anterior direction being orthogonal to the mounting surface.

2. The graphic display device of claim 1 wherein the anterior retainer portions each comprise an upper frontal portion and a lower frontal portion, and the posterior retainer portions each comprise a lower rearward portion, the lower frontal and rearward portions being aligned, the posterior portion lengths extending upwardly such that the upper rearward portions are located equidistant intermediate the lower and upper frontal portions.

3. The graphic display device of claim 1 wherein the posteriorly extending, retainer-engaging projections are formed at a point substantially equidistant intermediate the housing top and the housing bottom of the housing assembly for enhancing support of the housing assembly adjacent the mounting surface.

4. The graphic display device of claim 3 wherein the device-to-surface retainer structures each extend an arc length toward the housing bottom from the housing sides, the peripheral housing edging thereby being seatable in and upwardly supportable by medial portions of the laterally opposed device-to-surface retainer structures and the posteriorly extending, retainer-engaging projections, the device-to-surface retainer structures thus for enhancing support of the housing assembly adjacent the mounting surface.

5. The graphic display device of claim 4 wherein the anterior retainer portions each extend in laterally opposed arc lengths, the laterally opposed arc lengths being substantially equidistant intermediate the housing top and the housing bottom for enhancing support of the housing assembly adjacent the mounting surface.

6. The graphic display device of claim 1 comprising a light trap, the light trap being positionable in adjacency to the light guide within the panel-receiving volume for enhancing uniform light transmission from the light guide.

7. The graphic display device of claim 1 comprising, in combination, a graphic lens, the graphic lens comprising laterally opposed tab structures, the housing edging comprising laterally opposed tab-receiving voids for receiving said tab structures and thus for removably retaining the graphic lens in anterior adjacency to the light guide.

8. A graphic display device for illuminating a graphic panel, the graphic display device comprising:

a housing assembly, the housing assembly comprising a housing top, a housing bottom, a housing back, a housing front, and peripheral housing edging, the housing back comprising an assembly-receiving cavity and posteriorly extending fastener-engaging projections, the housing edging defining a panel-receiving volume in anterior adjacency to the assembly-receiving cavity;

a light source assembly, the light source assembly comprising, in electrical communication: a power source, a light source, and circuitry, portions of the light source assembly being receivable in the assembly-receiving cavity;

a light guide assembly, the light guide being positionable in anterior adjacency to the power source in edge adjacency to the light source for guiding light from the light source in an anterior direction orthogonal to a light guide plane of the light guide; and device-to-surface fastening structures for fastening the graphic display device to a mounting surface, the device-to-surface fastening structures each comprising an anterior fastener portion and a posterior fastener portion, the anterior fastener portions each having an anterior portion length, the posterior fastener portions each having a posterior portion length and an upper rearward portion, the upper rearward portions for supporting the housing assembly via the posteriorly extending, fastener-engaging projections, the posterior portion lengths being abbreviated relative to the anterior portion lengths for enhancing stability of the housing assembly, the device-to-surface fastening structures being cooperably associated with the peripheral housing edging for supporting the housing assembly such that the light from the light source is guided in the anterior direction, the anterior direction being orthogonal to the mounting surface.

9. The graphic display device of claim 8 wherein the anterior fastener portions each comprise an upper frontal portion and a lower frontal portion, and the posterior fastener portions each comprise a lower rearward portion, the lower frontal and rearward portions being aligned, the posterior portion lengths extending upwardly such that the upper rearward portions are located intermediate the lower and upper frontal portions.

10. The graphic display device of claim 9 wherein the device-to-surface fastener structures each comprise an edge-receiving void, the edge-receiving voids for receiving and retaining laterally opposed portions of the peripheral housing edging.

11. The graphic display device of claim 10 wherein the posteriorly extending fastener-engaging projections are formed at a point substantially equidistant intermediate the housing top and the housing bottom for engaging the upper rearward portions of the device-to-surface fastener structures, the posteriorly extending, fastener-engaging projections and device-to-surface fastener structures for enhancing support of the housing assembly adjacent the mounting surface.

12. The graphic display device of claim 11 wherein the peripheral housing edging is substantially circular, and the device-to-surface fastener structures each extend an arc length, the peripheral housing edging thereby being seatable and supportable by the laterally opposed device-to-surface fastener structures and posteriorly extending, fastener-engaging projections, the device-to-surface fastener structures thus for enhancing support of the housing assembly adjacent the mounting surface.

13. The graphic display device of claim 11 wherein the anterior fastener portions each extend substantially equidistant intermediate the housing top and the housing bottom for enhancing support of the housing assembly adjacent the mounting surface.

14. The graphic display device of claim 13 comprising a light trap, the light trap being positionable in adjacency to the light guide within the panel-receiving volume for enhancing uniform light transmission from the light guide.

15. The graphic display device of claim 13 comprising, in combination, a graphic lens, the graphic lens comprising laterally opposed tab structures, the housing edging comprising laterally opposed tab-receiving voids for receiving said tab structures and thus for removably retaining the graphic lens in anterior adjacency to the light guide.

16. A graphic display device for illuminating a graphic panel, the graphic display device comprising:

a housing assembly, the housing assembly comprising a housing back, a housing front, and peripheral housing edging, the housing back comprising laterally opposed, posteriorly extending fastener-engaging projections;

a light source assembly, the light source assembly comprising, in electrical communication: a power source, a light source, and circuitry;

a light guide, the light guide being positionable in anterior adjacency to the housing back for guiding light from the light source; and device-to-surface fastening structures for fastening the graphic display device to a mounting surface, the device-to-surface fastening structures each comprising an anterior fastener portion and a posterior fastener portion, the anterior fastener portions each having an anterior portion length, the posterior fastener portions each having a posterior portion length and an upper rearward portion, the upper rearward portions for supporting the housing assembly via the posteriorly extending, fastener-engaging projections, the posterior portion lengths being abbreviated relative to the anterior portion lengths for enhancing stability of the housing assembly, the device-to-surface fastening structures being cooperably associated with the peripheral housing edging for supporting the housing assembly such that the light from the light source is guided in an anterior direction.

17. The graphic display device of claim 16 wherein the device-to-surface fastening structures each comprise an edge-receiving void, the edge-receiving voids for receiving and retaining laterally opposed portions of the peripheral housing edging.

18. The graphic display device of claim 17 wherein the anterior fastener portions each comprise an upper frontal portion and a lower frontal portion, and the posterior fastener portions each comprise a lower rearward portion, the lower frontal and rearward portions being aligned, the posterior portion lengths extending upwardly such that the upper rearward portions are located centrally relative to the lower and upper frontal portions.

19. The graphic display device of claim 18 wherein the anterior fastener portions each extend substantially equidistant intermediate the housing top and the housing bottom for enhancing support of the housing assembly adjacent the mounting surface.

20. The graphic display device of claim 18 wherein the posterior portion lengths are positioned relatively nearer the housing bottom than the housing top for enhancing support of the housing assembly adjacent the mounting surface.

* * * * *